United States Patent [19]

Sloan

[11] Patent Number: 5,074,550

[45] Date of Patent: Dec. 24, 1991

[54] EXERCISE APPARATUS

[76] Inventor: Patrick J. Sloan, 46 Fairway Dr., Cresson, Pa. 16630

[21] Appl. No.: 548,697

[22] Filed: Jul. 5, 1990

[51] Int. Cl.[5] ..... A63B 21/008

[52] U.S. Cl. ..... 272/130; 272/65

[58] Field of Search ..... 272/65, 66, 70, 72, 272/97, 100, 130

[56] References Cited

U.S. PATENT DOCUMENTS

| | | | |
|---|---|---|---|
| 2,324,970 | 7/1943 | Woolley | 272/65 |
| 3,587,319 | 6/1971 | Andrews | 73/379 R |
| 4,225,131 | 9/1980 | Sidlinger et al. | 272/109 |
| 4,730,826 | 3/1988 | Sudmeier | 272/65 |
| 4,743,015 | 5/1988 | Marshall | 272/97 |
| 4,749,189 | 6/1988 | Frank | 272/900 X |
| 4,818,667 | 3/1989 | Watterson | 272/130 X |
| 4,824,100 | 4/1989 | Hall et al. | 272/65 |
| 4,836,530 | 6/1989 | Stanley, Jr. | 272/65 |
| 4,880,226 | 11/1989 | Krantz | 272/97 |
| 4,953,858 | 9/1990 | Zelli | 272/97 X |

*Primary Examiner*—Richard J. Apley
*Assistant Examiner*—L. Thomas
*Attorney, Agent, or Firm*—David B. Newman, Jr. & Associates

[57] ABSTRACT

An exercise apparatus including a minitrampoline, a frame, a first pole, a second pole, a first hydraulic shock, and a second hydraulic shock. The frame supports the minitrampoline above a floor. The first and second poles have handles, and are pivotally mounted to the frame. The first and second hydraulic shocks are pivotally connected to the frame and are clamped to the first and second poles, respectively. The frame may connect to a wall for stabilizing the exercise apparatus. A person exercises on the minitrampoline while holding onto the handles, with the first and second hydraulic shocks absorbing energy imparted by the person through the first and second poles.

13 Claims, 1 Drawing Sheet

EXERCISE APPARATUS

BACKGROUND OF THE INVENTION

This invention relates to an exercise apparatus for in house use, and more particularly an exercise apparatus for simulating jogging and skiing.

DESCRIPTION OF THE PRIOR ART

Exercises involving two legged hopping back and forth on the ground have been used in pre-season conditioning classes by ski instructors and coaches for may years, to simulate skiing and for jogging in place. These exercises teach quickness, agility, and the essential up and down weight coordination used in making linked parallel ski turns, or just exercising the legs. Such exercises build the important leg, arm, stomach, back and buttock muscles used for skiing and jogging, as well as the kind of heart and lung conditioning used for quick explosive burst of energy in down hill skiing and sprint jogging.

The disadvantages of these exercises is that they often are preformed on a floor by leaping back and forth or by jogging in place on a hard floor. Leaping back and forth or jogging in place on a hard floor may cause shock which can cause injury to the ligaments and joints.

A prior art apparatus using two rebounding surfaces is disclosed in U.S. Pat. No. 4,730,826 to Sudmeier, which discloses a rebounding exercise device having the two rebounding surfaces supported at an incline relative to horizontal. The low ends of the rebounding surfaces are near each other so that a user can rebound by jumping from one surface to the other.

OBJECTS AND SUMMARY OF THE INVENTION

An object of the present invention is to provide an exercise apparatus which can be used for simulating skiing or facilitating jogging indoors.

Another object of the present invention is to provide an exercise apparatus which enables a person to perform exercises which strengthen and condition the muscles for use in down hill skiing or jogging, without causing undue shock to the ligaments and joints.

According to the present invention, as embodied and broadly described herein, an exercise apparatus for use on a floor and near a wall by a person is provided comprising a minitrampoline, a frame, a first pole, a second pole, a first hydraulic shock and a second hydraulic shock. The frame has a first end with mean for supporting the minitrampoline above the floor. The frame has a second end with wall means for optionally connecting the frame to the wall. The first pole has a first end with a first handle, and a second end pivotally mounted near the second end of the frame. A first hydraulic shock pivotally is connected near the second end of the frame and clamped to the first pole. The second pole has a first end with a second handle. The second pole has a second end pivotally mounted near the second end of the frame. The second hydraulic shock pivotally is connected near the second end of the frame, and is clamped to the second pole. The wall means connects the frame to the wall for stabilizing the exercise apparatus. The person exercises on the minitrampoline while holding on to the first and second handles of the first and second poles. The first and second hydraulic shocks absorb energy imparted by the person through the first and second pole while exercising.

Additional objects and advantages of the invention will be set forth in part in the description which follows, and in part will be obvious from the description, or may be learned by practice of the invention. The objects and advantages of the invention also may be realized and obtained by means of the instrumentalities and combinations particularly pointed out in the appended claims.

BRIEF DESCRIPTION OF THE DRAWINGS

The accompanying drawing, which is incorporated in and constitutes a part of this specification, illustrates particular embodiments of the invention, and together with the description, serves to explain the principles of the invention.

DETAILED DESCRIPTION OF THE PREFERRED EMBODIMENTS

Figure 1:
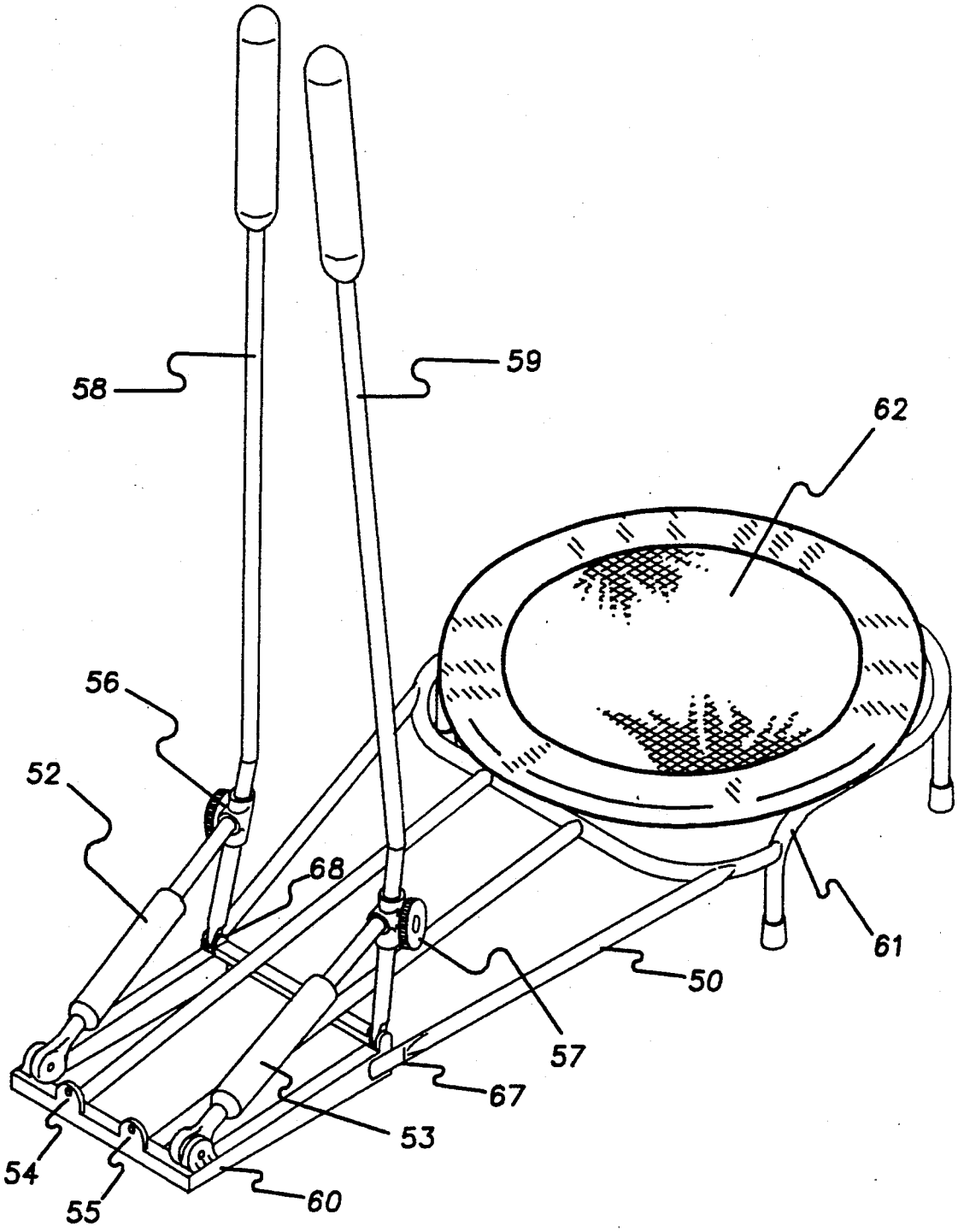
FIG. 1 shows an preferred embodiment of the exercise apparatus according to the present invention.

Reference will now be made in detail to the present preferred embodiments of the invention, an example of which is illustrated in the accompanying drawing.

Referring to FIG. 1, a preferred embodiment of the exercise apparatus is shown, for use on a floor and near a wall by a person. The exercise apparatus comprises a minitrampoline 62, a frame 50, a first pole 58, a second pole 59, first shock means, and second shock means. The first shock means may be embodied as a first hydraulic shock 52, and the second shock means may be embodied as a second hydraulic shock 53. The frame 50 has a first end 61 and a second end 60. The first end 61 of the frame 50 includes means for supporting the minitrampoline 62 above a floor. The second end 60 of the frame 50 includes wall means which may optionally connect the frame 50 to a wall. The frame 50 is not required, however, to be connected to the wall. As shown in FIG. 1, the wall means may be projections 54, 55 having outlets for inserting screws therethrough. The stability of the exercise apparatus increases by connecting the frame 50 to the wall. The first pole has a first end with a first handle, and a second end pivotally mounted 68 near the second end 60 of the frame 50. The second pole 59 has a first end with a second handle, and has a second end pivotally mounted 67 near the second end 60 of the frame 50. Broadly, the first pole 58 and the second pole 59 may be mounted by any means for connecting to the frame 50.

A first hydraulic shock 52 pivotally is connected near the second end 60 of the frame 50 and clamped with first clamp 56 to the first pole 58. A second hydraulic shock 53 is pivotally connected near the second end 60 of the frame 50 and clamped with second clamp 57 to the second pole 59. The first clamp 56 and the second clamp 57 allow adjusting the angles of the first and second poles 58, 59, with respect to the person using the exercise apparatus. The first and second clamps 56, 57 also assist in adjusting the position of the first and second hydraulic shocks 52, 53.

The exercise apparatus accordingly may be used by a person for exercising on the minitrampoline while holding on to the first and second handles of the first and second poles 58, 59. While exercising, the person may exert weight on the first and second poles 58, 59, thereby causing the first and second hydraulic shocks 52, 53 to absorb energy imparted by the person through the first and second poles 58, 59.

The minitrampoline 62 may include a mat which is suspended by a plurality of tension springs from the first end 61 of the frame 50. Alternatively, rubber or other flexible material may be employed to flexibly suspend the mat from the first end 61 of the frame 50.

The minitrampoline may be constructed by using similar techniques as taught for supporting a mat, and employing tension springs, in U.S. Pat. No. 4,730,836 to Sudmeier, which is incorporated herein by reference.

The frame 50 may include additional support members connected in the middle for added strength, as shown in FIG. 1.

A person exercises on the exercise apparatus of FIG. 1, by jogging or flexing on the minitrampoline 62 while holding onto the first and second poles 58, 59. As one flexes or leans forward towards the first and second poles 58, 59, the first and second hydraulic shocks 52, 53 absorb energy.

It will be apparent to those skilled in the art that various modifications can be made to the exercise apparatus of the instant invention without departing from the scope or spirit of the invention, and it is intended that the present invention cover modifications and variations of the exercise apparatus provided they come within the scope of the appended claims and their equivalents.

I claim:

1. An exercise and jogging apparatus for use on a floor and near a wall by a person, comprising:

a minitrampoline having a mat of flexible material flexibly supported from a trampoline frame;

a frame having a first end with means for supporting said minitrampoline above said floor, and having a second end with wall means for connecting said frame to said wall;

a first pole having a first end with a first handle, and having a second end pivotally mounted near the second end of said frame;

a first hydraulic shock pivotally connected near the second end of said frame and clamped to said first pole;

a second pole having a first end with a second handle, and having a second end pivotally mounted near the second end of said frame;

a second hydraulic shock pivotally connected near the second end of said frame and clamped to said second pole; and wherein said wall means connects said frame to said wall for stabilizing said exercise and jogging apparatus, and said person exercises and jogs on said minitrampoline while holding onto said first and second handles, with said first and second hydraulic shocks absorbing energy imparted by said person through said first and second poles.

2. An exercise and jogging apparatus for use on a floor and near a wall by a person, comprising:

a minitrampoline having a mat of flexible material flexibly supported from a trampoline frame;

a frame having a first end, and have a second end;

a first pole having a first end with a first handle, and having a second end pivotally mounted near the second end of said frame;

a first hydraulic shock pivotally connected near the second end of said frame and connected to said first pole;

a second pole having a first end with a second handle, and having a second end pivotally mounted near the second end of said frame;

a second hydraulic shock pivotally connected near the second end of said frame and connected to said second pole; and wherein said person exercises and jogs on said minitrampoline while holding onto said first and second handles, with said first and second hydraulic shocks absorbing energy imparted by said person through said first and second poles.

3. The exercise and jogging apparatus as set forth in claim 2, wherein said minitrampoline is connected to the first end of said frame.

4. The exercise and jogging apparatus as set forth in claim 2, further including wall means for connecting said frame to said wall for stabilizing said exercise apparatus.

5. An exercise and jogging apparatus for use by a person, comprising:

a minitrampoline having a mat of flexible material flexibly supported from a trampoline frame;

a frame having a first end, and having a second end;

a first pole having a first end, and having a second end mounted near the second end of said frame;

a first hydraulic shock connected near the second end of said frame and connected to said first pole;

a second pole having a first end, and having a second end mounted near the second end of said frame;

a second hydraulic shock connected near the second end of said frame and connected to said second pole; and wherein said person exercises and jogs on said minitrampoline while holding onto said first and second poles, with said first and second hydraulic shocks absorbing energy imparted by said person through said first and second poles.

6. The exercise and jogging apparatus as set forth in claim 5, wherein said minitrampoline is connected to the first end of said frame.

7. The exercise and jogging apparatus as set forth in claim 5, further including wall means for connecting said frame to a wall for stabilizing said exercise apparatus.

8. The exercise and jogging apparatus as set forth in claim 5, wherein the first ends of said first pole and said second pole having a first handle and a second handle, respectively.

9. An exercise and jogging apparatus for use by a person, comprising:

a minitrampoline having a mat of flexible material flexibly supported from a trampoline frame;

a frame having a first end and having a second end;

a first pole having a first end, and having a second end pivotally mounted near the second end of said frame;

first shock means connected near the second end of said frame and connected to said first pole for absorbing energy imparted by said person through said first pole;

a second pole having a first end, and having a second end pivotally mounted near the second end of said frame;

second shock means connected near the second nd of said frame and connected to said second pole for absorbing energy imparted by said person through said second pole; and wherein said person exercises and jogs on said minitrampoline while holding onto the first ends of said first and second poles.

10. The exercise and jogging apparatus as set forth in claim 9, wherein said minitrampoline is connected to the first end of said frame.

11. The exercise and jogging apparatus as set forth in claim 9, further including wall means for connecting said frame to a wall for stabilizing said exercise apparatus.

12. The exercise and jogging apparatus as set forth in claim 9, wherein said first shock means and said second shock means include a first hydraulic shock and a second hydraulic shock, respectively.

13. The exercise and jogging apparatus as set forth in claim 9, wherein the first ends of said first pole and said second pole have a first handle and a second handle, respectively.

* * * * *

UNITED STATES PATENT AND TRADEMARK OFFICE

CERTIFICATE OF CORRECTION

PATENT NO. : 5,074,550

DATED : December 24, 1991

INVENTOR(S) : PATRICK J. SLOAN

It is certified that error appears in the above-identified patent and that said Letters Patent is hereby corrected as shown below:

Column 1, line 24, change "preformed" to --performed--;

line 52, change "mean" to --means--; and

Column 4, line 62, change "second nd" to --second end--.

Signed and Sealed this

Thirteenth Day of July, 1993

*Attest:*

Michael K. Kirk

MICHAEL K. KIRK

*Attesting Officer*

*Acting Commissioner of Patents and Trademarks*